US006443240B1

(12) United States Patent
Scott

(10) Patent No.: US 6,443,240 B1
(45) Date of Patent: Sep. 3, 2002

(54) DUAL RISER ASSEMBLY, DEEP WATER DRILLING METHOD AND APPARATUS

(75) Inventor: Robert J. Scott, Sugarland, TX (US)

(73) Assignee: Transocean Sedco Forex, Inc., Houston, TX (US)

( * ) Notice: Subject to any disclaimer, the term of this patent is extended or adjusted under 35 U.S.C. 154(b) by 0 days.

(21) Appl. No.: 09/413,030

(22) Filed: Oct. 6, 1999

(51) Int. Cl.[7] ..... E21B 15/02

(52) U.S. Cl. ..... 175/7; 166/358; 166/359; 166/367

(58) Field of Search ..... 175/5, 7; 166/352, 166/353, 354, 358, 367, 359

(56) References Cited

U.S. PATENT DOCUMENTS

| | | | | |
|---|---|---|---|---|
| 2,808,229 A | | 10/1957 | Bauer et al. | |
| RE26,668 E | | 9/1969 | Word et al. | |
| 4,068,729 A | | 1/1978 | Peevey | |
| 4,147,221 A | | 4/1979 | Ilfrey et al. | |
| 4,444,275 A | * | 4/1984 | Beynet et al. | 175/7 |
| 4,819,730 A | * | 4/1989 | Williford et al. | 166/355 |
| 5,184,686 A | | 2/1993 | Gonzales | |
| 5,377,763 A | | 1/1995 | Pearce et al. | |
| 6,085,851 A | * | 7/2000 | Scott et al. | 175/7 |

FOREIGN PATENT DOCUMENTS

| | | |
|---|---|---|
| NL | 0156782 | 5/1978 |

* cited by examiner

*Primary Examiner*—William Neuder
(74) *Attorney, Agent, or Firm*—Bradford E. Kile; Kile, Goekjian, Lerner & Reed, PLLC

(57) ABSTRACT

A dual riser assembly for use with an offshore multi-activity drilling assembly to conduct drilling operations from a deck above the surface of a body of water into the bed of the body of water utilizing two risers, a first and a second, which extend from a location above the surface of a body of water to a common location adjacent to the bed of the body of water. Each riser terminates, at a distal end, into a dual riser assembly, allowing for selective open internal communication between each of the two risers and a single wellhole.

19 Claims, 4 Drawing Sheets

DUAL RISER ASSEMBLY, DEEP WATER DRILLING METHOD AND APPARATUS

RELATED PATENTS

This invention relates to a method and apparatus for conducting drilling offshore with a multi-activity drillship, or the like, disclosed and claimed in U.S. application for patent Ser. No. 08/642,417, now U.S. Pat. No. 6,085,851 entitled "Multi-Activity Offshore Exploration and/or Development Drilling Method and Apparatus." Additionally, this application relates to U.S. application Ser. No. 09/212,250 entitled "Dynamically Positioned, Concentric Riser, Drilling Method and Apparatus," now U.S. Pat. No. 6,273,193. Both of these related patents are of common assignment with the subject application.

BACKGROUND OF THE INVENTION

This invention relates to a novel method and apparatus for offshore drilling operations. More specifically, this invention relates to a dual riser method and apparatus for use in drilling and/or production work over of a single well hole in deep water applications. The subject invention enables a deep water drilling rig, having dual turntables, to work simultaneously through two parallel risers to shorten the critical path associated with deep water drilling and/or work over activity.

Significant oil and gas reserves have been discovered beneath various bodies of water throughout the world. Originally, the state of technology limited offshore drilling and production to relatively shallow locations in shoreline areas where the depth of the water ranged from a few feet to several hundred feet. The extensive exploration and removal of resources from these near shore regions, coupled with a constant demand for cost effective energy from large, productive reserves, have led to a search for and drilling of oil and gas reserves in locations beneath greater depths of water.

Presently, the industry is conducting drilling operations in depths of 7,500 feet of water, and it is anticipated that these operations will migrate to even deeper waters since the industry has begun leasing blocks for drilling in areas where the depth of water can be ten thousand feet or more. In this, it is predicted that the oil industry will soon be drilling in depths of water twelve thousand feet or more. These desires will only grow as technology, such as seismic imaging, continues to progress and identify locations of substantial oil and gas reserves that are buried under even greater depths of water.

In the past, shallow-water offshore drilling operations have been conducted from fixed towers and mobile units, such as jack-up platforms. These units are usually assembled on shore and then transported to an offshore drilling site. For a tower unit, the towers are erected over a proposed well head and fixed to the marine floor. A jack-up platform may be transported to the site through the use a barge or through a self-propulsion mechanism on the platform itself. Once the platform is over the proper location, legs on the corners of the barge or self-propelled deck are jacked down into the seabed until the deck is positioned above the statistical storm wave height. These jack-up barges and platforms drill through a relatively short riser in a manner similar to land based operations. Although jack-up rigs and fixed platforms work well in depths of water that total approximately a few hundred feet, they do not work well in deep water operations.

For operations in deep water, semi-submersible platforms have been successfully utilized, such as disclosed in United States Ray et al. U.S. Pat. No. 3,919,957 and Steddum U.S. Pat. No. 3,982,492. Tension leg platforms are designed with a platform and a plurality of cylindrical legs or columns which are buoyant and extend into the sea. Tension leg platforms are held in place by anchors that are fixed into the seabed and by a plurality of permanent mooring lines connected beneath each buoyancy column. These mooring lines are tensioned to counteract the buoyancy of the legs and stabilize the platform. A further example of a tension legged platform is disclosed in United States Ray et al. U.S. Pat. No. 4,281,613.

For sites with even greater depths of water, turret moored drillships and dynamically positioned drillships serve as a platform for drilling operations. Turret moored drillships are depicted in United States Richardson et al. U.S. Pat. Nos. 3,191,201 and 3,279,404. Dynamically positioned drillships are similar to turret moored drillships in that drilling occurs through a large central opening, or moon pool, fashioned vertically through the vessel amid ships. Bow and stern thruster sets cooperate with multiple sensors and computer controls to maintain the vessel at set coordinates. A dynamically controlled drillship and riser angle positioning system is disclosed in United States Dean U.S. Pat. No. 4,317,174.

Regardless of the equipment utilized, whenever drilling operations are conducted in deep water, greater costs are encountered as compared to operations in shallower depths of water. These increased costs are compounded by the additional time needed to make-up and break down drillstrings during a conventional drilling operation.

In a conventional offshore drilling operation thirty inch (30") casing is first jetted into the initial mudline of a well hole and is cemented into position. A twenty-six inch (26") hole section is then drilled through the casing. The twenty-six inch (26") drilling assembly is then pulled back to the surface and twenty inch (20") tubular casing is landed on the well head and the twenty inch (20") casing is cemented into place. An eighteen and three-quarters inch (18¾") blowout preventer ("BOP") stack is connected to the bottom of a twenty-one inch (21") riser and lowered onto the well head and tested. After this operation is completed and the twenty-one inch (21") riser is set, all further drilling actually takes place through the single twenty-one inch (21") riser. This includes drilling a seventeen and one-half inch (17½") hole, running and cementing thirteen and three-eighths inch (13⅜") casing, drilling a twelve and one-quarter inch (12¼) hole section, running and cementing a nine and rive-eighths inch (9⅝") casing, drilling an eight and one-half inch (8½") hole, etc.

Each segment of the drilling operation including changing bits requires casing or drill pipe segments to be made up in thirty-one foot (31") segments at a rotary drillship station and lowered to the seabed in increments.

Drilling time was significantly reduced in offshore operations by the development of a dual-activity drillship by Scott et al. in the above-referenced U.S. Pat. No. 6,081,851 entitled "Multi-Activity Offshore Exploration and/or Development Drilling Method and Apparatus." The disclosure of this Scott et al. patent is hereby incorporated by reference as though set forth at length.

Notwithstanding the significant advances provided by the Scott et al. dual-activity drillship invention, once the BOP stack was mounted at the bottom of the twenty-one inch (21") riser and latched to the well head all further drilling activity must be conducted through the riser.

In addition to thousands of feet drilled into the seabed, for an operation conducted at a water depth of 7,500 feet, the extra time taken to cycle any drilling assembly through the drilling riser from the drillship to seabed averages about five hours per cycle. Since the design of a normal rig only provides for drilling through one rotary table onto which the single drilling riser is attached, drilling operations must be ceased during the period of time needed to pull a spent drilling assembly from a well up the riser and also during the period while a new drilling assembly is lowered down the riser and into the well.

Accordingly, it would be desirable to increase the drilling efficiency of a dual-activity drillship, even further, by reducing lost time drawing up and paying out drillstrings through the drilling riser running from the drillship to the seabed in deep water.

OBJECTS AND SUMMARY OF THE INVENTION

Objects

It is, therefore, a general object of the subject invention to provide a novel, deep water, drilling method and apparatus operable to enhance the drilling efficiency of a dual-activity drilling assembly.

It is a specific object of the invention to provide a novel method and apparatus for reducing the time involved in drilling wells located beneath substantial depths of water.

It is a particular object of the subject invention to reduce the operational time needed for cycling drilling assemblies through a marine riser section of deep water drilling activity.

It is another object of the subject invention to allow a multi-activity drilling assembly to operate efficiently in locations where the water depths of seven thousand feet or more.

It is a further object of the invention to provide a novel method and apparatus removing significant segments of time from the critical path of a deep water drilling operation.

It is a related object of the invention to provide a novel method and apparatus of enhanced activity to fully utilize the capacity of a dual-activity drillship of the type described in U.S. Pat. No. 6,085,851.

It is a specific object of the invention to provide a novel dual riser, deep water, drilling method and apparatus operable for permitting two drilling and/or casing string to be run simultaneously from a drillship to a well hole in a posture operable for selective insertion into a subsea well hole.

BRIEF SUMMARY OF A PREFERRED EMBODIMENT OF THE INVENTION

A preferred embodiment of the invention which is intended to accomplish at least the above-referenced objects comprises a dual riser assembly for use with an offshore multi-activity drilling assembly having provision for a pair of risers. The invention is designed to conduct drilling procedures between the deck of a dual-activity drilling assembly above the surface of the body of water and a single well location in the bed of the body of water.

The dual riser assembly is operable to be connected to a single BOP of a well hole and includes plural riser segments. A first riser segment has a longitudinal axis substantially coincident with the longitudinal axes of a first riser from the surface drilling assembly and the well hole. A second riser segment extends from the dual riser assembly at an acute angle with respect to the first riser segment and is in selective communication with the first riser segment.

Each riser segment of the subject invention is equipped with a valve, or blind rams, that may be independently opened or closed to respectively connect or seal off the riser above the well hole. The isolating properties of these valves accommodate the method of running simultaneous drillstrings in a non-active riser to a point above the valves without disrupting any activity being performed through the corpus of the assembly and well hole from the active riser.

In one embodiment of the invention a flex joint is positioned between the base of the dual riser assembly and the head of a BOP stack such that an active one of two marine risers may be brought into axial alignment with the bore of the well hole and eliminate any tendency for alignment wear at the junction between the dual riser assembly and the BOP stack.

THE DRAWINGS

Other objects and advantages of the present invention will become apparent from the following detailed description of a preferred embodiment thereof, taken in conjunction with the accompanying drawings, wherein.

Figure 4A:
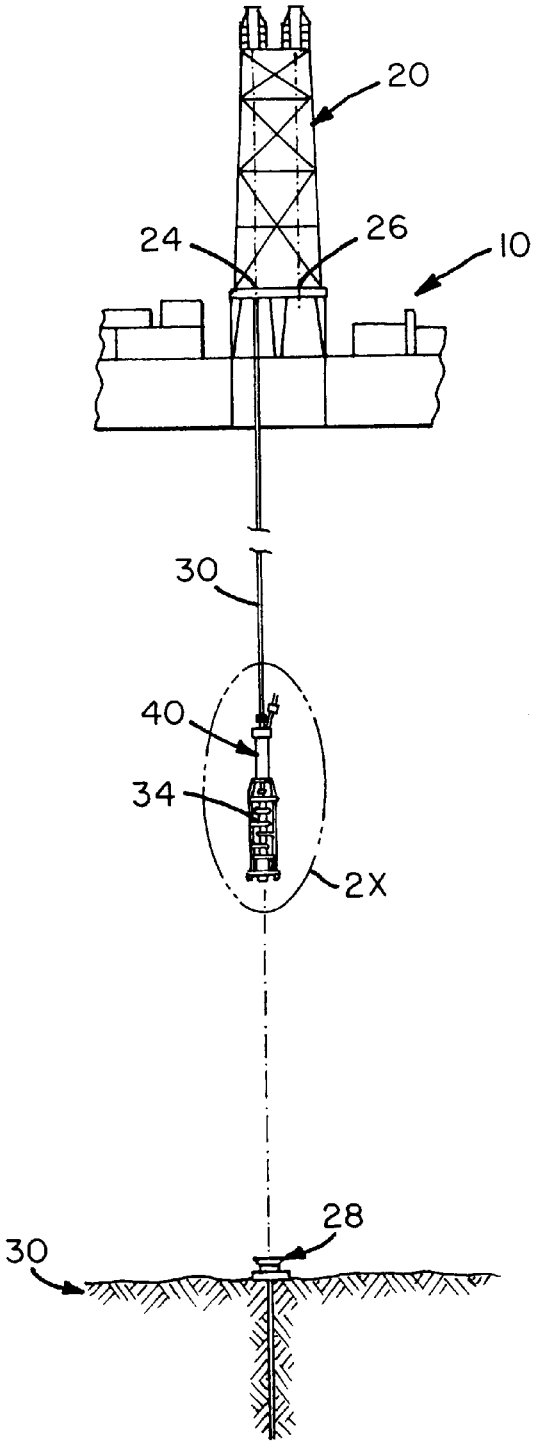
FIG. 4A is a schematic representation of a sequence of use of the subject invention, disclosing a BOP stack at 2X, or twice its scale size, connected to a dual riser assembly, also shown at 2X connected to the bottom of a twenty-one inch (21") riser and being lowered for attachment to a well head.
Figure 4B:
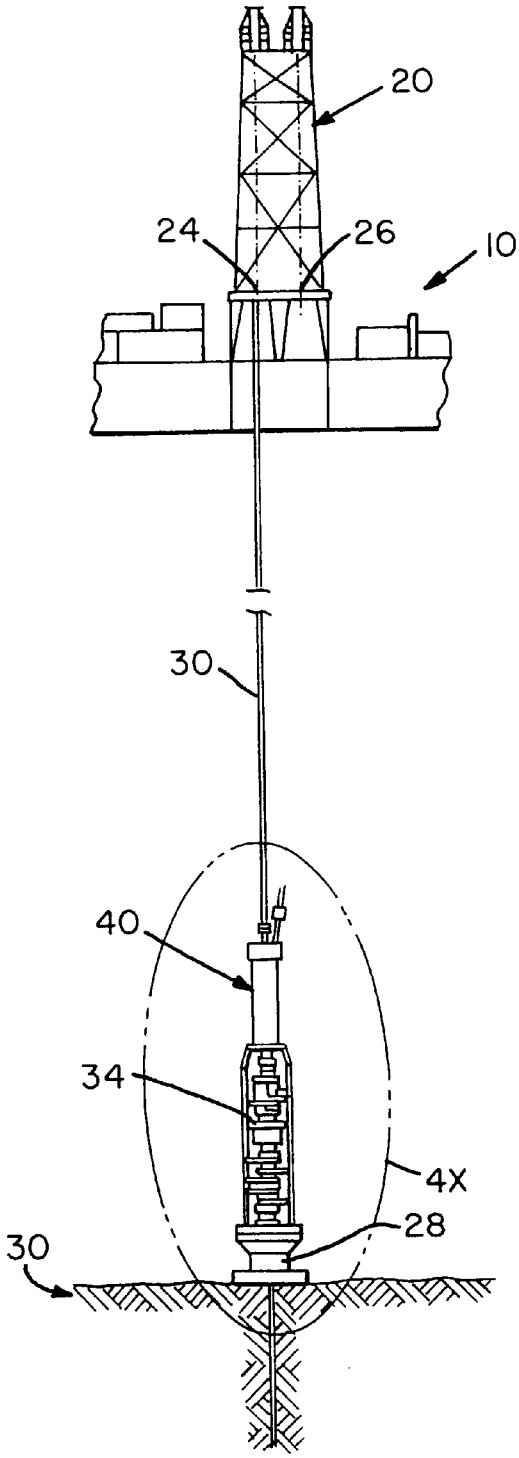
FIG. 4B is a schematic representation of the step of orienting the BOP stack, shown now at 4x, and dual riser assembly prior to attachment to the well head located on the marine floor.
Figure 4C:
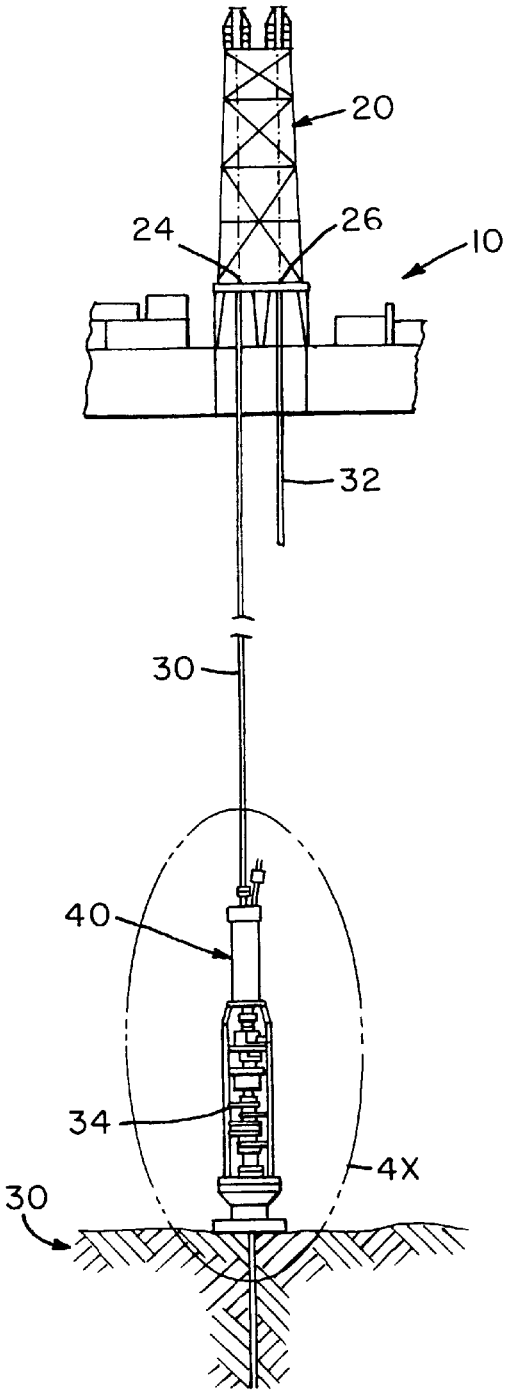
Figure 4D:
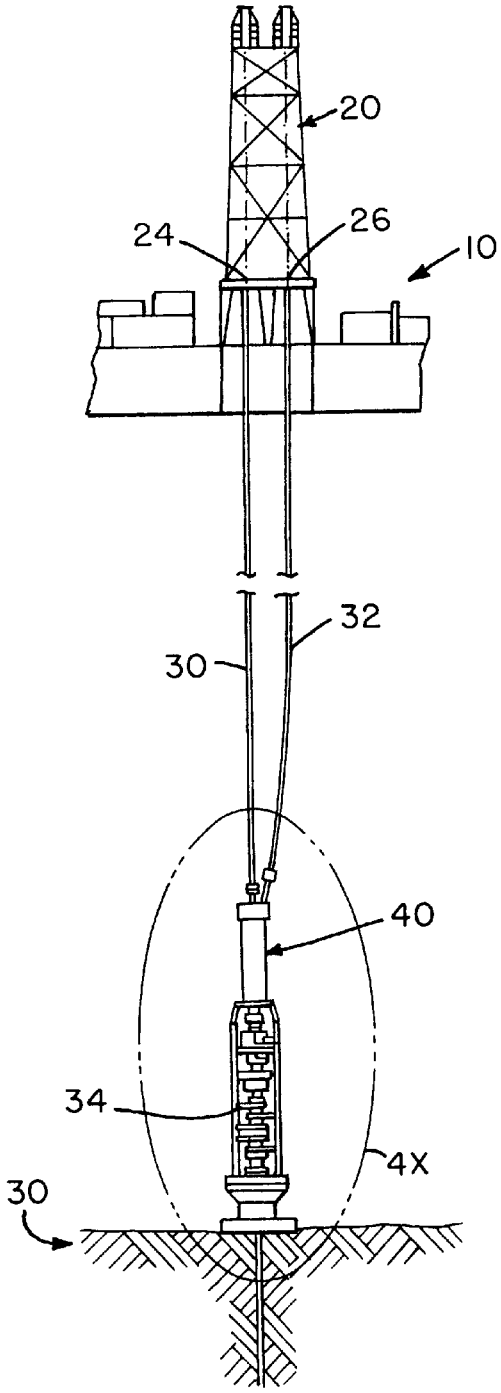

FIG. 4C is a schematic illustration of the sequence of use of the invention of where the BOP stack is secured and tested on the well head and a thirteen and five-eighths inch (13⅝") riser is run to the dual riser assembly at the seabed; and FIG. 4D is a schematic representation of the dual riser assembly of the subject invention operably connecting a second, smaller riser to a first, longer riser above a BOP stack.

DETAILED DESCRIPTION OF A PREFERRED EMBODIMENT OF THE INVENTION

Context of the Invention

Figure 1:
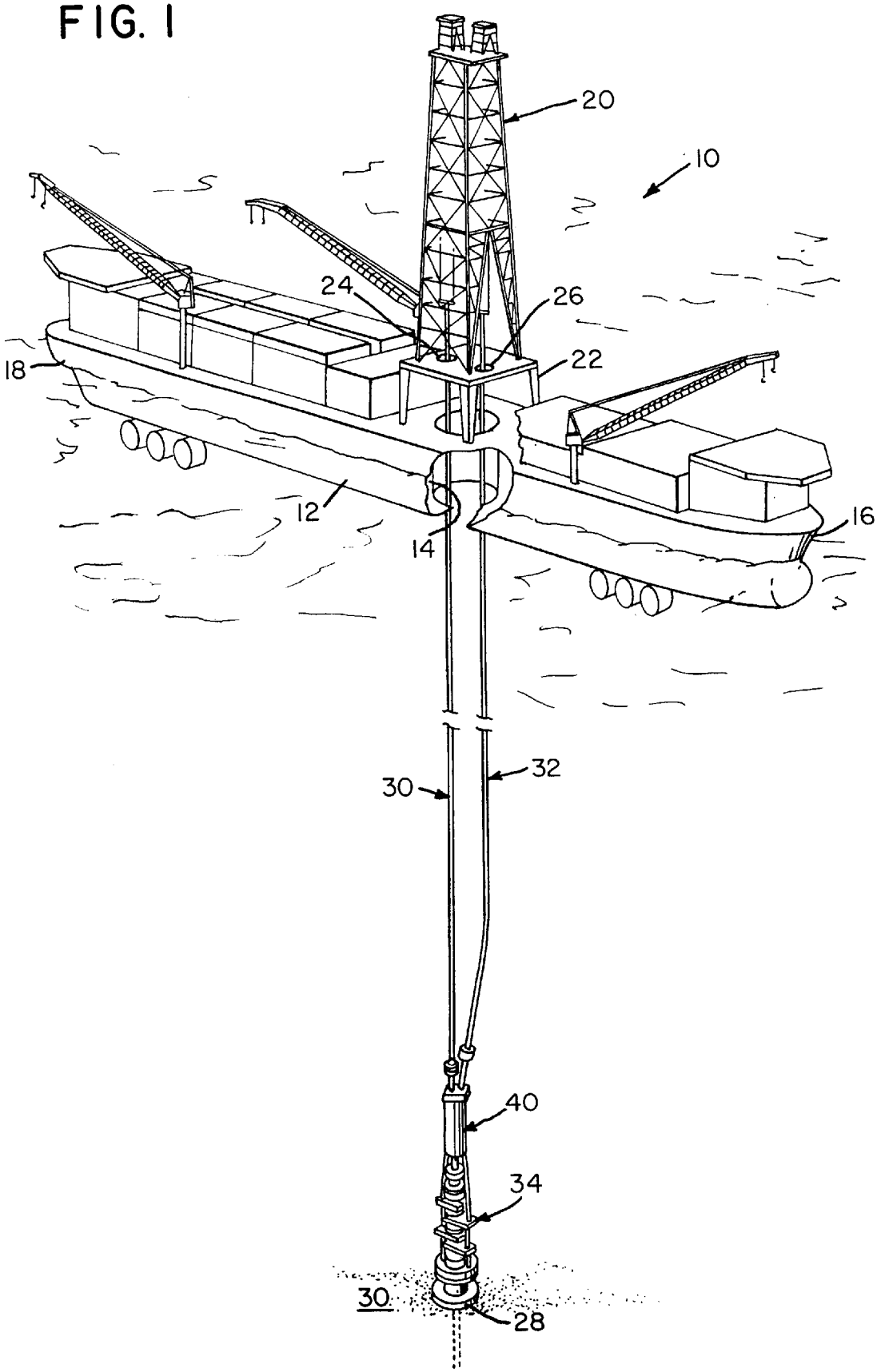
FIG. 1 is an axonometric view of a drillship of the type that is suitable to advantageously utilize the dual riser assembly method and apparatus for deep water drilling in accordance with the subject invention.

Referring now to the drawings, wherein like numerals indicate like parts, and initially to FIG. 1, there is shown an axonometric view of a dynamically positioned drillship with a central moon pool operable to receive drilling tubulars. A drillship of the type envisioned for use of the subject invention is disclosed and described in the above-referenced U.S. Pat. No. 6,085,851 entitled "Multi-Activity Offshore Exploration and/or Development Drilling Method and Apparatus." This patent is of common assignment with the subject application and the disclosure of this patent has been previously incorporated by reference in this application as though set forth at length. Briefly, however, a dynamically positioned drillship 10 comprises a tanker-type hull 12 which is fabricated with a large moon pool or opening 14 extending generally vertically between the bow 16 and stern 18 of the drillship. A multi-activity derrick 20 is mounted upon superstructure 22 connected to the drillship above the moon pool 14 and is operable to conduct primary tubular operations and simultaneously operations auxiliary to primary drilling operations from the single derrick 20. The single derrick 20 includes a first 24 and second 26 rotary station that is operable to support dual risers and drilling activity simultaneously for a single well hole.

In operation, the drillship 10 is maintained on station by being dynamically positioned. Dynamic positioning is performed by using a plurality of bow thrusters and stern thrusters which are accurately and dynamically controlled by on-board computers using satellite and earth input data to control the multiple degrees of freedom of the floating vessel in varying environmental conditions of wind, current, wave swell, etc. Dynamic positioning is relatively sophisticated and highly accurate. Dynamic positioning is capable of accurately maintaining a drillship at a desired latitude and longitude, on station over a well head 28 at the seabed 30, within a matter of a foot or so.

Although a dynamically positioned drillship is disclosed and is a preferred method of conducting drilling operations in accordance with the subject inventive system, it is envisioned that in certain instances a dynamically positioned, semi-submersible may also be utilized as the primary drilling unit and thus drillships, semi-submersibles, tension leg platforms and similar floating drilling units, for deep water applications are contemplated as an operative environment of the subject invention.

Dual Riser Assembly

As noted above, and in the Scott et al. U.S. Pat. No. 6,085,851, the dual-activity drilling assembly includes a first 24 and second 26 drilling station. A first riser 30 extends through the moon pool and is supported by dynamically tensioned rams within the moon pool such as disclosed in the above-referenced Hermann et al. U.S. Pat. No. 6,273,193. After an initial thirty inch (30") casing is jetted in and a twenty-six inch (26") casing is set, the riser 30 is typically a twenty-one inch (21") main drilling riser extending from the second drilling station 26. The second riser 32 can again be twenty-one inches (21") in diameter but is preferably a smaller riser of thirteen and five-eighths inches (13⅝") in diameter as will be discussed more fully below.

The first 30 and the second 32 risers are operably joined together near the seabed by a dual riser assembly 40 in accordance with the subject invention. The dual riser assembly 40, in turn, is connected through a flex joint to the top of a BOP 34 which in turn is latched to the well head 28.

Figure 2:
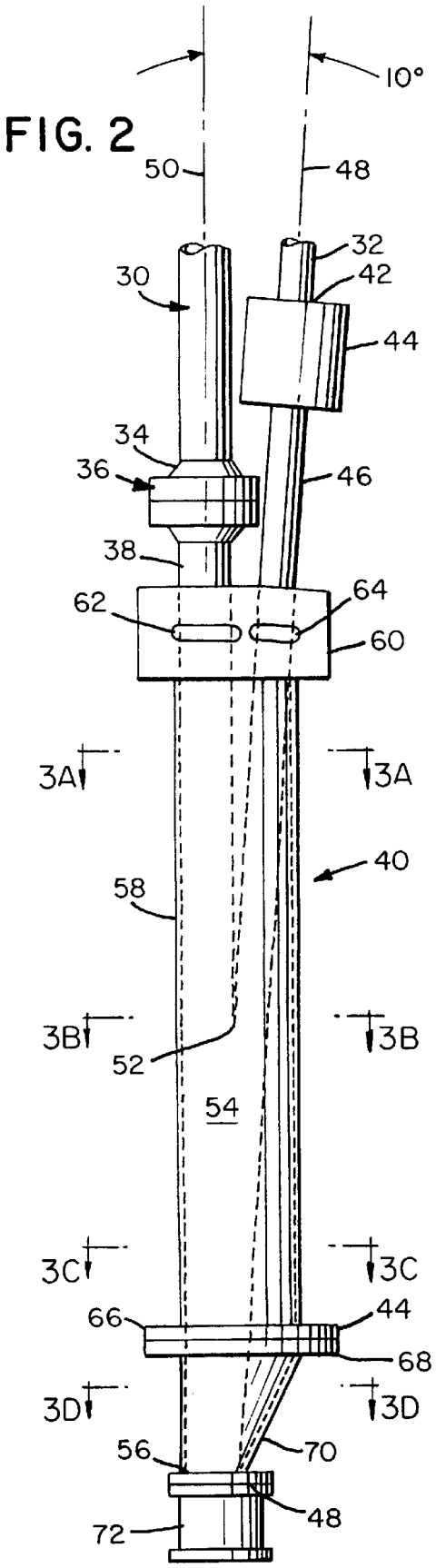
FIG. 2 is a side elevational view of a dual riser assembly in accordance with a preferred embodiment of the invention.
Figure 3A:
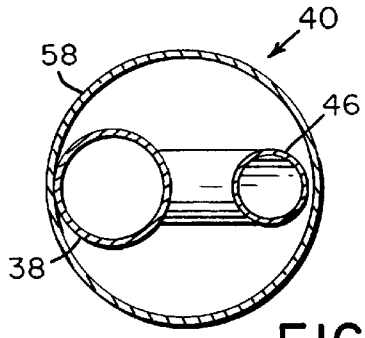
FIG. 3A is a cross-sectional view, taken along section line 3A—3A, and discloses the spatial relationship of the riser segments near the top of the dual riser assembly.

Referring now to FIG. 2, there is shown a side view of the present dual riser assembly 40 configured in a preferred embodiment of the invention. A distal end 34 of the first riser string 30, descending from the drillship 10, is attached by a dual mating flange 36 to a first riser segment or branch 38 of the dual riser assembly 40 to the dual mating flange 36. Although various designs may be used for the dual mating flanges 36, American Petroleum Institute (API) flanges are preferred. Similarly, a distal portion 42 of a second riser string 32 is attached by a riser connector 44 to a second riser segment 46. Although depicted as a block, the riser connector 44 may be two American Petroleum Institute (API) flanges. The second riser segment 46 has a central longitudinal axis 48 which is angled approximately ten degrees (10°) degrees with respect to the first riser segment 38. Accordingly, the first and second riser segments, as shown in cross-section in FIG. 3A, converge and merge, beginning at a location 52, note FIGS. 2 and 3, into a common passageway, note FIG. 3C.

The first 38 and second 46 riser segments are welded along an elliptical junction and smoothly transition into the common passageway 54 and jointly terminate at a distal end 56 with a diameter substantially equal to the diameter of the largest of the first and second riser segments. In order to fix the spatial relationship of the first and second riser segments, a cylindrical extension tube 58 surrounds the converging segments and provides peripheral support to prevent separation of the riser segments. Alternatively, bands or an open lattice support cage may be used, however, a closed cylindrical column or tube 58 is preferred.

At the top of the column 58 an end closure 60 is provided and includes a first blind ram 62 and a second blind ram 64 which operably and selectively are used to close off fluid passage through the first 38 and second 46 riser segments respectively. Other remotely activatable valve arrangements may be used, however, blind rams are preferred.

A conventional API flange 66 is fitted at the bottom of the column 58 and operably is connected to a counter flange 68 forming the top of a transition or taper joint 70. The top of the taper joint has a diameter similar to the diameter of support column 58 and the bottom of the taper joint 70 has a diameter substantially the same as the largest of the riser segments, note FIG. 3D.

Finally, the dual riser assembly terminates into a conventional high pressure, flex joint 72 which in turn is operably attached to the top of a BOP stack 34, note again FIG. 1.

Preferred Embodiment of the Dual Riser Assembly

Although the first 38 and second 46 riser segments may have the same or similar diameters, in a preferred embodiment the first riser segment has a twenty-one inch (21") diameter and the second riser segment 46 has a thirteen and five-eighths inch (13⅝") diameter. The dual blind ram 60 is composed of a twenty-one inch (21") valve 62 and a thirteen and five-eighths inch (13⅝") valve 64 that are positioned transversely with respect to the longitudinal axis of the riser branch segments 38 and 46. The larger, twenty-one inch (21") riser branch segment 38 passes through the twenty-one inch (21") valve 62 of the dual blind ram 60, and the smaller, thirteen and five-eighths (13⅝") riser branch segment 46 passes through the thirteen and five-eighths (13⅝") valve 64 of the dual blind ram set 60. Each of the valves may function independently to isolate the portion of the riser branch segment located above the active valve from the portions of the riser branch segments 38 and 46 located within the corpus of the extension column or tube 58.

Beneath the point 52 where the riser branch segments 38 and 46 first merge, the riser branch segments, now in open communication, descend through the cavity of the tubular column 52 into the taper joint 70 where the fully merged riser branch segments terminate with a connection through a flex joint 72 to an eighteen and three-fourths inch (18¾") BOP stack 34. The extension tube 58 is a tubular column that houses and protects the junction of the merging riser branch segments 38 and 46 and isolates the junction from an ambient sea environment.

Preferred Embodiment of the Invention

Referring again to FIGS. 3A–3D, there are shown cross-sectional views near the top of the extension tube 58 looking down towards the base of the dual riser segment 32. The longitudinal axis 50 of the larger, twenty-one inch (21") riser 30 and riser branch segment 38 is positioned at a substantially identical angle to the angle of a longitudinal axis of the extension tube 58; thus, the larger riser branch segment 38 descends substantially parallel to the extension tube 58. The longitudinal axis 48 of the smaller, thirteen and five-eighths inch (13⅝") riser branch segment 46 is placed at an acute angle of ten degrees (10°) with respect to the longitudinal axes of the larger riser branch segment 38 and the extension tube 58; thus, the smaller riser branch segment 46 can be seen to merge into the larger riser branch segment 38 as the riser branch segments descend through the cavity of the extension tube 58.

Figure 3B:
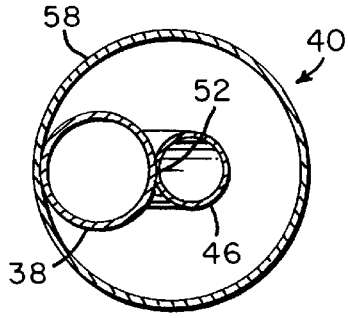
FIG. 3B is a cross-sectional view, taken along section line 3B—3B, and discloses the spatial relationship of the riser segments at a location above merger of a second, smaller riser segment with a first, larger riser segment.

Referring again to FIG. 3B, there is shown a cross-sectional view of the extension tube 58 just above the junction 52 of the riser branch segments 38 and 46. The larger riser branch segment 38 continues to descend parallel to the extension tube 58, while the smaller riser branch segment 46 continues to descend at an acute angle with respect to the larger riser branch segment. The two riser branch segments 38 and 46 begin to merge at point just below the cross-sectional position that is illustrated in FIG. 3B.

Figure 3C:
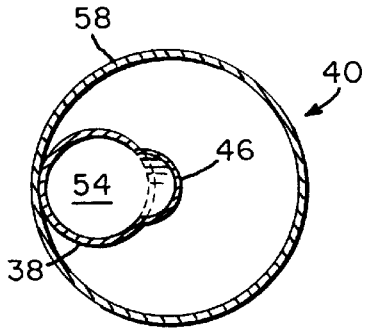
FIG. 3C is a cross-sectional view, taken along section line 3C—3C, and discloses the riser segments at a location where the second, smaller riser segment has partially merged with the first, larger riser segment.

Referring to FIG. 3C, there is shown a cross-sectional view near the base of the extension column or tube 58 looking towards the base dual riser assembly 40. The smaller riser branch segment 46 is substantially merged and is in open communication at region 54 with the larger riser branch segment 38.

Figure 3D:
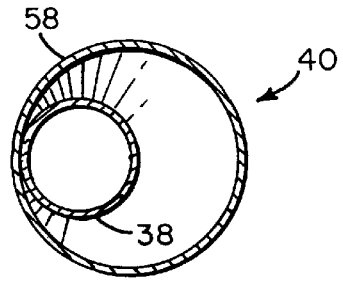
FIG. 3D is a cross-sectional view, taken along section line 3D—3D, and discloses the riser segments at a location where the second, smaller riser has completely merged, in a taper joint, into the first, larger riser segment near the bottom of the dual riser assembly.

FIG. 3D shows a cross-sectional view of the taper joint 70 looking down to the base of the assembly. The smaller riser branch segment 46 has fully merged into the larger riser branch segment 38.

Although in many applications the gradual transition provided by an approximately ten degree (10°) merger may be sufficient to provide smooth access to the well head through either riser, in certain instances, this angle can be decreased if needed. Moreover, it may be desirable to laterally shift the drillship from a position wherein the first drilling station is directly over the well hole to a position where the second drilling station is at least partially over the well hole. In this instance the flex joint 72 is used to provide a smooth, essentially linear, alignment of either the first riser 30 or the second riser 32 with the axial bore of the well hole.

Sequence of Operation

Referring now to FIGS. 4A–4D there will be seen a sequence of views disclosing the use or operation of the subject dual riser assembly 40 in the overall context of an offshore, deep water drilling operation.

After a thirty inch (30") casing is jetted into a well site and a twenty-six inch (26") casing is drilled and cemented the dual-activity drilling rig 20 picks up the dual riser assembly 40 and installs the assembly on top of a BOP stack 34. Once the dual riser assembly 40 is hooked up to the BOP control system 34 and tested, the rig then runs the BOP and dual riser assembly 40 down to the well head 28, as shown in FIG. 4A. Although FIG. 4A is drawn somewhat to scale the region embraced within a phantom line ellipse in FIG. 4A is drawn to two times scale to illustrate details of the invention.

A twenty-one inch (21") casing 30 is connected to riser segment 38 of the dual riser assembly 40. The second blind ram 64 is closed and thus the interior of the dual rig assembly 40 is isolated from the ambient sea environment during this running sequence. In FIG. 4A the distance between the drillship 10 and the well head 28 can vary depending upon the depth of water at a drilling site but usually is between several hundred and several thousand feet. The drilling efficiency provided by the subject invention is of particular interest in water of depths in excess of 3,000 feet and is exceptionally useful in 7,500 or more feet of water.

As shown in FIG. 4B, prior to landing and latching the BOP 34 onto the well head 28, the dual riser assembly 40 is rotated so that its orientation provides approximate alignment of the second riser segment 46 with the second station 26 of the dual-activity drilling rig 20. This FIG. 4B and the remaining FIGS. 4C and 4D depict an elliptical region in phantom lines at 4x to facilitate illustration of the invention.

Once the BOP stack 34 is secured and tested on the well head 28 a secondary rig site 26 within the dual drilling rig 20 proceeds to run a thirteen and five-eighths inch (13⅝") riser into the sea and down to the dual riser assembly 40.

Turning to FIG. 4D, once the second riser is run and aligned with the connector 44, the second riser is latched to the riser segment 46.

With both the first 30 and second 32 risers in place the dual-activity drilling rig 20 is operable for conducting operations to the BOP stack selectively through either riser. More specifically, during the time that the thirteen and five-eighths inch (13⅝") casing is being run and cemented in place through the twenty-one inch (21") riser 30, the twelve and one-quarter inch (12¼") drilling assembly to drill the next section of the well is run down through the thirteen and five-eighths inch (13⅝") riser 32 to a point just above the thirteen and five-eighths inch (13⅝") second blind ram 64. After the casing landing string has been pulled up clear of the BOP stack into the twenty-one inch (21") riser, and the twenty-one inch (21") first blind ram 62 is closed, the thirteen and five-eighths inch (13⅝") second blind ram 64 is opened allowing the twelve and one-quarter inch (12¼") drilling assembly to be run in the well to carry out drilling on the next well section.

As the twelve and one-quarter inch (12¼") drilling assembly is being run to the bottom of the well, the ship moves laterally to allow the thirteen and five-eighths inch (13⅝") riser to be re-aligned vertically through the flex joint 72 with the BOP stack 34. This then allows the drilling assembly to be rotated without causing any undue wear in the BOP stack, well head or the casing immediately below the mudline.

During the time that the well is being drilled through the thirteen and five-eighths inch (13⅝") riser the primary rig 24 operating on the twenty-one inch (21") riser 30 can be breaking down the tubular used to land the casing or picking up and standing back in the derrick the casing for the next section of the well. After this has been accomplished the rig then makes up a new bit and runs the new bit down through the twenty-one inch (21") riser and waits until the bit is pulled out of the well for replacement through the thirteen and five-eighths inch (13⅝") riser. The drilling assembly located in the twenty-one inch (21") riser is then run down to the bottom of the well and continues the drilling process. This sequence can be continued throughout the well drilling process thereby significantly reducing the time taken to cycle the drilling assemblies between the rig and the mudline.

SUMMARY OF MAJOR ADVANTAGES OF THE INVENTION

After reading and understanding the foregoing description of a preferred embodiment of the invention, in conjunction with the illustrative drawings, it will be appreciated that several distinct advantages of the subject method and apparatus of a dual riser assembly are obtained.

Without attempting to set forth all of the desirable features and advantages of the instant method and apparatus, at least some of the major advantages of the invention are realized by the provision of dual riser segments 38 and 46 that are operably joined within the dual riser assembly 40. This enables a dual-activity drillship having, having a pair of rotary stations 24 and 26 to be efficiently used in tandem with dual operating risers between the drillship and a subsea BOP.

The flex joint 72 enables the dual riser assembly to be shifted by laterally repositioning the drillship to selectively orient each riser segment 38 and 46 into axial alignment with a central longitudinal axis of the BOP and well hole.

With the subject dual riser assembly 40 and a dual-activity drillship, two drill strings can be made-up and sent to the seabed traversing 7,500 or more feet and be ready for use upon retraction of a spent bit, or the like, on the other drill string. When the ambient water is this deep, five or more days can be saved with each trip to the seabed. This removal of days from the critical path has the potential of significantly reducing the time and cost of a complete offshore drilling operation.

In describing the invention, reference has been made to a preferred embodiment and illustrative advantages of the invention. In particular, a dual riser assembly 40 has been specifically illustrated and discussed in its presently envisioned preferred embodiment. Those skilled in the art, and familiar with the instant disclosure of the subject invention, may also recognize other additions, deletions, modifications, substitutions, and/or other changes which will fall within the purview of the subject invention and claims.

What is claimed is:

1. A dual riser assembly for use with an offshore multi-activity drilling assembly designed to conduct drilling operations from a deck above the surface of a body of water and into the bed of the body of water using a first riser and a second riser extending from a location above the surface of the body of water to a location adjacent the bed of the body of water, said dual riser assembly comprising:

a first riser segment being operable to be connected at one end to a distal end of said first riser and having a central longitudinal axis extending substantially coincident to a central longitudinal axes of said first riser;

a second riser segment operable to be connected at one end to a distal end of said second riser and having a central longitudinal axis extending substantially coincident to a central longitudinal axis of said second riser;

said first riser segment and said second riser segment being connected and merged together at their other ends into open internal communication with an acute angle being formed by the central longitudinal axes of said first riser segment and said second riser segment;

a first valve connected at approximately said one end of said first riser segment to selectively isolate the first riser from the first riser segment;

a second valve connected at approximately said one end of said second riser segment to selectively isolate the second riser from the second riser segment; and means for operably connecting the merged other ends of said first riser segment and said second riser segment to a well hole to be drilled.

2. A dual riser assembly as defined in claim 1 wherein said mean for operably connecting comprises:

a direct connection between the merged other ends of said first riser segment and said second riser segment to said well head of a well hole to be drilled.

3. A dual riser assembly as defined in claim 2 and further comprising:

a blowout preventer stack positioned between said means for operably connecting and the well head of said well hole to be drilled.

4. A dual riser assembly as defined in claim 3 and further comprising:

a flex segment connected between the merged other ends of said first and second riser segments and the top of the blowout preventer stack.

5. A dual riser assembly as defined in claim 1 and further comprising:

means connected to and being operable for maintaining a fixed spatial relationship of said first riser segment and said second riser segment.

6. A dual riser assembly as defined in claim 5 and further comprising:

a cylindrical column extending about and supporting a portion of said first riser segment and said second riser segment.

7. A dual riser assembly as defined in claim 6 and further comprising:

a taper joint extending between a bottom portion of said cylindrical column and the other ends of the merged first and second riser segments.

8. A dual riser assembly as defined in claim 7 and further comprising:

a flex joint connected at a base portion of said taper joint and interposed between the taper joint of said dual riser assembly and a well head of a well to be drilled.

9. A dual riser assembly as defined in claim 1 wherein said first valve connected to first riser segment comprises:

blind rams.

10. A dual riser assembly as defined in claim 1 wherein said second valve connected to second riser segment comprises:

blind rams.

11. A dual riser assembly as defined in claim 1 wherein:

said first riser segment and said second riser segment have substantially equal diameters.

12. A dual riser assembly as defined in claim 1 wherein:

said first riser segment has a larger diameter than said second riser segment.

13. A dual riser assembly as defined in claim 12 wherein:

said first riser segment has a diameter measuring approximately twenty-one inches (21") and said second riser segment has a diameter measuring approximately thirteen and five-eighths inches (13⅝").

14. A dual riser assembly as defined in claim 12 wherein:

said means for operably connecting the merged ends of said first riser segment and said second riser segment comprises:

a tubular column which operably encompasses the merged junction of said first riser segment with said second riser segment and operably fixes a spatial angular relationship of the first and second riser segments.

15. A dual riser assembly as defined in claim 14 wherein:

said means of operably connecting and fixing spatial and angular relationship of the first and second riser segments further comprises a taper joint extending from a base segment of said tubular column to a reduced diameter flange operable for connecting to a blowout preventer assembly for said well hole.

16. A dual riser assembly as defined in claim 1 wherein:

said acute angle between the central longitudinal axes of said first riser segment and said second riser segment being approximately ten degrees.

17. A method for conducting offshore drilling operations on a single well hole from a multi-activity drilling assembly having a first riser extending from above the body of water to the seabed and a second riser extending from above the body of water to the seabed, said method comprising the steps of:

joining the first riser with the second riser in fluid communication at a distal end adjacent a well hole to be drilled into the seabed;

closing the second riser from fluid communication with the first riser;

conducting drilling operations from a first drilling assembly into the well hole from the multi-activity drilling assembly through the first riser; and during at least a portion of said drilling operations extending a second drilling assembly from the multi-activity drilling assembly through the second riser to a position adjacent to a subsea well head of a well hole to be drilled.

18. A method for conducting offshore drilling operations on a single well hole from a multi-activity drilling assembly as defined in claim 17 and further comprising the steps of:

withdrawing the first drilling assembly from the well hole up into the first riser above a means for closing the first riser at approximately the seabed;

closing the first riser at approximately the seabed from fluid communication with the second riser;

opening the second riser at approximately the seabed; and conducting drilling operations from the second drilling assembly from the multi-activity drilling assembly into the well hole from the second riser.

19. A method for conducting offshore drilling operations on a single well hole from a multi-activity drilling assembly as defined in claim 18 and further comprising the steps of:

prior to conducting drilling operations from the second drilling assembly through the second riser, laterally adjusting the angular position of the second drilling assembly to generally axially align the second riser with a central longitudinal axis of the well hole.

* * * * *